United States Patent [19]

Sebrosky et al.

[11] 4,273,040

[45] Jun. 16, 1981

[54] SEGMENTED DRUM BAR HELIX PRINTER

[75] Inventors: Robert A. Sebrosky, Newtown, Pa.; William D. Thorne, Wake Forest, N.C.

[73] Assignee: International Business Machines Corporation, Armonk, N.Y.

[21] Appl. No.: 79,761

[22] Filed: Sep. 28, 1979

[51] Int. Cl.[3] ..... B41J 3/08

[52] U.S. Cl. ..... 101/93.04; 400/121; 346/101

[58] Field of Search ..... 101/93.04, 93.09; 400/121, 118; 346/101

[56] References Cited

U.S. PATENT DOCUMENTS

| | | | |
|---|---|---|---|
| 2,666,807 | 1/1954 | Hunt | 178/30 X |
| 3,128,693 | 4/1964 | Thiemann | 101/93.09 |
| 3,286,625 | 11/1966 | Petit | 101/93.09 |
| 3,409,904 | 11/1968 | Maiershofer | 346/101 |
| 3,678,847 | 7/1972 | Pear et al. | 101/93.04 X |
| 3,810,195 | 5/1974 | Kilroy et al. | 346/101 |
| 3,812,495 | 5/1974 | Venker | 346/101 |
| 3,843,955 | 10/1974 | Pear | 101/93.04 X |

*Primary Examiner*—Paul T. Sewell

*Attorney, Agent, or Firm*—Edward H. Duffield

[57] ABSTRACT

Disclosed is an improved form of a mosaic printer of the bar helix type. The helical raised threads on the printer drum instead of being continuous are broken into segments which are offset axially on the drum. This produces a significant increase in throughput by reducing waiting time for the drum to rotate a section of continuous thread into alignment with a hammer at the start of a new helical pattern.

7 Claims, 6 Drawing Figures

SEGMENTED DRUM BAR HELIX PRINTER

FIELD OF THE INVENTION

This invention relates to mosaic printers in general and to bar helix printers in particular. In these printers a rotating drum has raised helical threads which are impacted by one or more fixed position hammers, the intersection between the hammer and the thread producing a dot or mark in the form of the intersectional area therebetween. Inked ribbon and paper or other media are interposed between the hammer and the helical thread patterns on the drum.

PRIOR ART

Numerous bar helix mosaic printers are known. Typical structures of the type contemplated as illustrative of bar helix printers in general are shown by U.S. Pat. Nos. 3,678,847, 3,810,195, 3,286,625, 3,812,495, 2,666,807, 3,409,904, and 3,843,955 to name a few.

In all of the aforementioned patents, where a continuous helical thread or threads are used, it is necessary to wait for the drum to rotate a sufficient distance to bring the helical pattern back into position to be struck by the hammer to create a new dot in the same vertical column on the sheet of paper. This waiting time may be reduced by applying multiple helical threads to the drum, but the wait will still be that required between the helical threads. This may be seen in the afore-mentioned U.S. Pat. Nos. 3,409,904, 3,678,847, 3,810,195 and 3,843,955 for example.

Various attempts to segment or break up the helical pattern of threads to improve registration between the thread and the hammer have also been made as shown by U.S. Pat. Nos. 3,286,625 and 3,812,495 for example. In the first mentioned patent, a segmented thread is used. The segments of the threads are spaced circumferentially in straight lines so that misregistration or small timing errors between firing of the hammer and impacting the thread segments will not cause a deviation in the horizontal location of the resulting mark. In the second case noted, U.S. Pat. No. 3,812,495, the spiral threads are approximately continuous but are interrupted in a small area in which it is desired not to print dots for example, between characters in a horizontal print line. This is also used to prevent a hammer of length slightly greater than the pitch of characters from striking a thread in two separate places.

In each of the aforementioned prior art patents, however, the waiting time still remains that necessary to rotate the drum from one helical thread pattern to the next. This may be demonstrated to require a significantly longer time than the present invention in which the helical thread patterns are broken into segments with the segments offset or overlapped relative to one another in such a fashion that the time required to move from the end of one segment to the beginning of the next segment is much shorter and can be accomplished by less rotation of the print drum than is otherwise the case.

OBJECTS OF THE INVENTION

In view of the difficulties noted with respect to the prior art mentioned above, it is an object of this invention to provide an improved mosaic printer of the bar helix type in which throughput or printing is accomplished at a higher rate by modifying the thread design to reduci the waiting time necessary for the drum to rotate a new helical pattern portion into alignment with a given print hammer.

SUMMARY OF THE INVENTION

The foregoing and still other unenumerated objects are met in the present invention by providing a continuously rotating drum having plural helical thread patterns on it. The individual thread patterns are broken into segments which are offset in the circumferential direction from one another but which continue in the same spiral path pitch angle as would occur if they were a continuous helical thread. This effectively freezes the apparent horizontal translation of the intersection between the helical thread and a fixed position hammer which spans several incremental horizontal distances. Thus, when a character or the final dot in a character has been printed, the paper may be advanced in the vertical direction, for example, and a new horizontal row of dots may be begun. The waiting time to bring the helical pattern into registration with a hammer in the first column in which dots are to be printed is reduced substantially by the fact that the helical thread is segmented so that the next segment to pass in front of a given hammer may be reached without the full rotation otherwise required to bring the same helical thread back into the same position or to reach the next helical thread in the event that multiple helical threads are used.

DETAILED SPECIFICATION

As indicated by the above-noted patents, mosaic printers of the bar helix type are well known. Although they will not be described in detail herein, they briefly comprise a continuously rotating drum with a raised helical thread pattern on it. Several raised helical thread patterns may be used if desired to increase throughput. Printing is accomplished by impacting a portion of the helical thread with a printing hammer which spans one or more potential dot printing locations on the axis of the drum. Paper and a suitable marking medium such as an inked ribbon are interposed between the hammer position and the helical threads so that, upon impact, a small mark or dot in the form of the intersectional area between the hammer and the helical thread may be produced on the paper. A suitable rotating emitter grid is usually attached with the drum. This grid may be provided with magnetic or optical marks upon it to facilitate proper firing timings for the hammers. One or more hammers may be spaced axially along the line of the drum axis and may be fired (sequentially or simultaneously) called serially or in parallel to print dots which may comprise portions of one or more characters. Paper may be moved incrementally or continuously, but when it is moved continuously, the row of hammers must be offset slightly in the circumferential direction or "skewed" in order to print a continuous horizontal line of dots on the paper as is well-known in the art.

Figure 1:
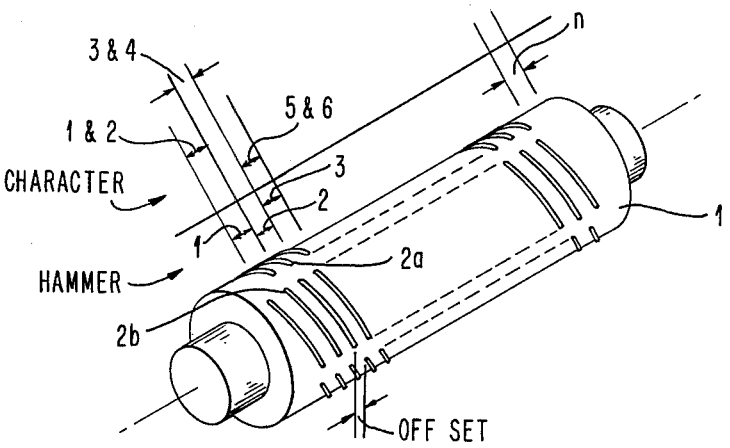
FIG. 1 illustrates a typical bar helix drum with segmented helical thread patterns according to the invention and shows the character and hammer spacing superimposed above and along the axial distance of the drum.

Turning to FIG. 1, a schematic representation of a preferred embodiment of this invention utilizing several segmented helical threads on a drum is shown. Drum 1 is circular in cross section and has one or more series of helical thread paths made up of segments circumferentially spaced along the helical path as shown. Segments 2A and 2B are parts of separate helical paths. It may be seen from the diagram that each segment is offset from the preceding or succeeding one in its own path by a small distance and by a gap or interruption of fixed size. Illustrated over the top portion of drum 1 are the character positions and hammer positions, each hammer spanning two possible character positions in a horizontal print line. FIG. 1 thus illustrates the drum for a bar helix line printer in which discontinuous slightly offset overlapped helical threads are used.

Characters to be printed are produced by firing the print hammers (not shown) against the paper and inked ribbon (not shown) to make a dot or mark at the intersection of the helical thread and the hammer as is well known in the art. In the figures herein, eight separate helical threads start paths are utilized for a seven dot high matrix printed character so that wear will be distributed evenly over the thread portions.

Figure 6:
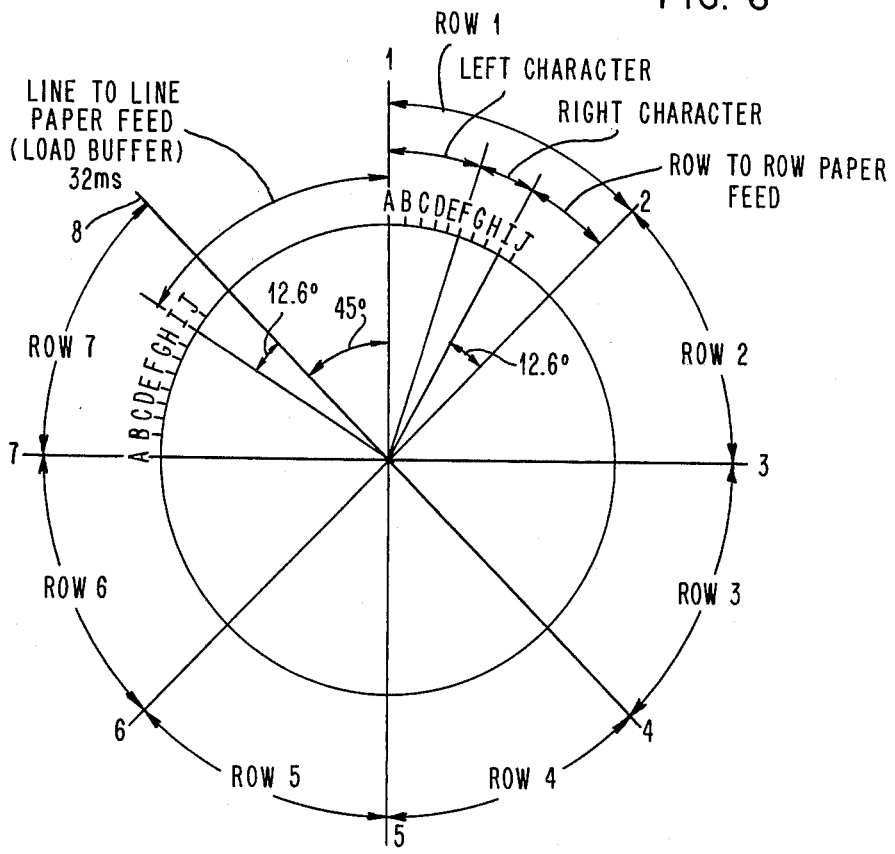
FIG. 6 illustrates a schematic timing chart diagram showing the end view of a helical drum with the positions and times for character printing, paper incrementing, etc., laid out on it. It may be used to represent the emitter firing grid of the type normally employed in printer of this type.

For a brief discussion of how an eight thread segmented two character wide bar actuator three hundred line per minute bar-helix printer operation consider the following:

The drum 1 is rotated at a constant speed of 300 RPM. Sixty-six two character bar actuators or hammers are utilized for a 132-character line printer and are spaced at fixed distances along the axis of drum 1 as shown in FIG. 1 (and schematically in FIGS. 3 and 4 as well). To print dots, the timing of the firing of the hammers is synchronized to strike near the beginning (the end of a segment which first passes under a print hammer position) and the hammers are fired or actuated approximately every two milliseconds. When the print hammer bars strike a helical segment, the first dot of the first row is formed for a character. Two milliseconds later, the hammers may be fired again to strike the same segment a second time and a second dot in the first row will be formed. For a typical four or five by seven array of dots to form characters as are commonly employed in the art, the firing of the hammers must continue for nine times in succession with the fifth firing time skipped to allow for a horizontal space between characters. Then the paper is incremented the vertical distance between dot rows while the drum is rotated from one thread segment to the next. It should be appreciated that the drum 1 rotates continuously and that the spacing between segments is chosen relative to the rotational speed of the drum so that when the paper is incremented and the time necessary for this operation has elapsed, the next thread segment will be in position to begin with the first dot in the next row to construct a character. The process is continued seven times for a standard seven dot high character and then the paper is incremented a vertical distance equal to that necessary between lines of characters while the drum 1 rotates past one complete thread segment as shown in FIG. 6.

Figure 2:
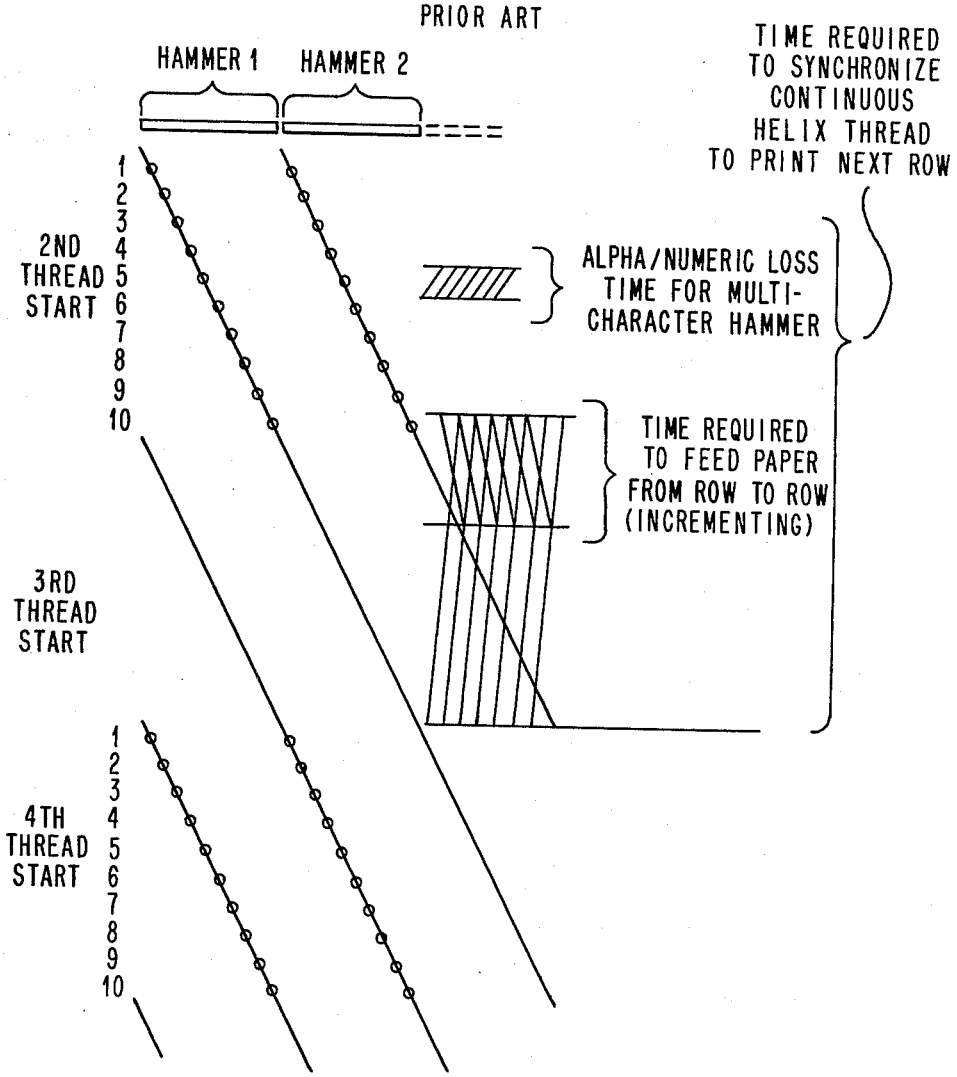
FIG. 2 PRIOR ART
FIG. 2 illustrates the typical prior art multi-thread helix drum and shows the timing problem involved.

Turning to FIG. 2, a typical continuous helical thread drum schematic is shown of the type that is known in the prior art. At the top of FIG. 2 each hammer position for spanning two possible characters is shown and the diagram is drawn to assume starting with the second thread of multi threads on a drum. Dots are illustrated along the path of the continuous helical thread to show the points on the thread which will be contacted by hammer 1 or 2 etc., in constructing eight horizontal dots and two horizontal spaces to form the first row of dots in two adjacent characters with a single hammer.

For convenience, the dots are numbered on the left hand edge of the diagram 1 through 10 and dots 5 and 10 are circled to show that they are skipped or blank spaces. The time necessary for the helical thread to pass at a given rotational speed is indicated to the right of space 5 as the alpha numeric time loss that is generated whenever a multi character print hammer is used since one dot position must be skipped in order to create a space between characters. When all of the dots in a first row have been printed by appropriate firing of the hammers against the helical threads, the paper must be incremented. This utilizes a period of time approximately as shown in FIG. 2 when the paper has been advanced by one dot row height. It will be noted that in this time the helical threads on the typical drum will have moved effectively so that approximately dot position four or five is positioned under the hammer. Therefor, an additional delay is necessary to wait to resynchronize the thread position with the hammers to begin printing dots in position #1.

In the diagram of FIG. 2, a character that was started by printing with the second thread has its first row of dots completed when the second thread has passed, the third thread start on the drum passes by or is partly elapsed during the time necessary to feed the paper and re-establish synchronization so that the fourth thread start is the first time in which synchronization is achieved for beginning printing of the second row of dots.

It will be appreciated that this description is most general and is related to the actual incremental speed which the paper can achieve by paper drive devices (not shown) and by the rotational speed of drum 1. However, these factors only affect the proportional amount of delay as will be appreciated by those of skill in the art.

Figure 3:
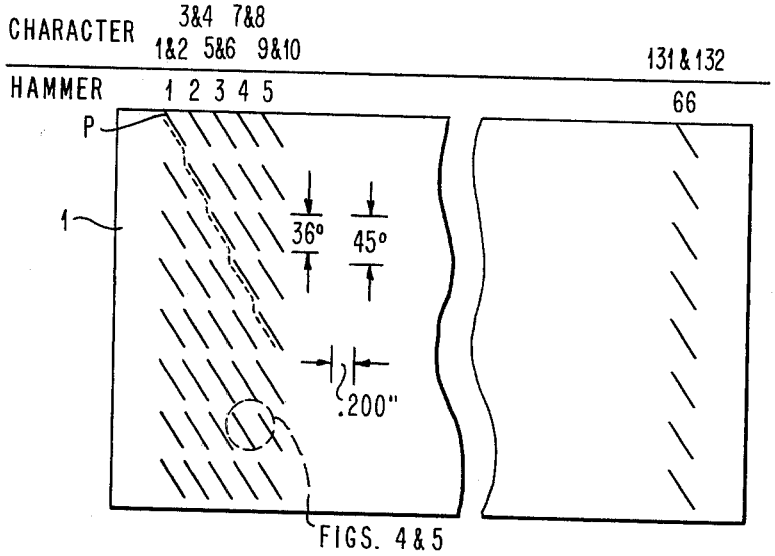
FIG. 3 illustrates the typical thread pattern of the present segmented helical thread invention in a preferred embodiment thereof.

Turning to FIG. 3, a schematic layout for a drum with segmented helical patterns according to the present invention is shown with the pattern cut and "flattened out" for simplicity. Again, character positions are grouped in pairs to be spanned by the hammers 1, 2, 3, 4, 5, etc., through 66 as illustrated at the top of FIG. 3. It will be seen that a given helical thread path P on drum 1 is composed of several segments which are spaced apart from one another circumferentially and which are staggered with respect to one another so that the end of a first segment aligns with the beginning of a second segment in the circumferential direction. The segments as shown in the preferred embodiment occupy 36° of arc in the circumference of drum 1 and the total circumference utilized for a segment and the intervening space between the end of a segment and the beginning of a succeeding segment is approximately 45°. The segments are set at a pitch angle which spans approximately 0.2" in the preferred embodiment. As stated previously, eight effective thread starts are used for a seven dot high character printer in order to distribute wear and eight thread starts are shown in FIG. 3.

Figure 4:
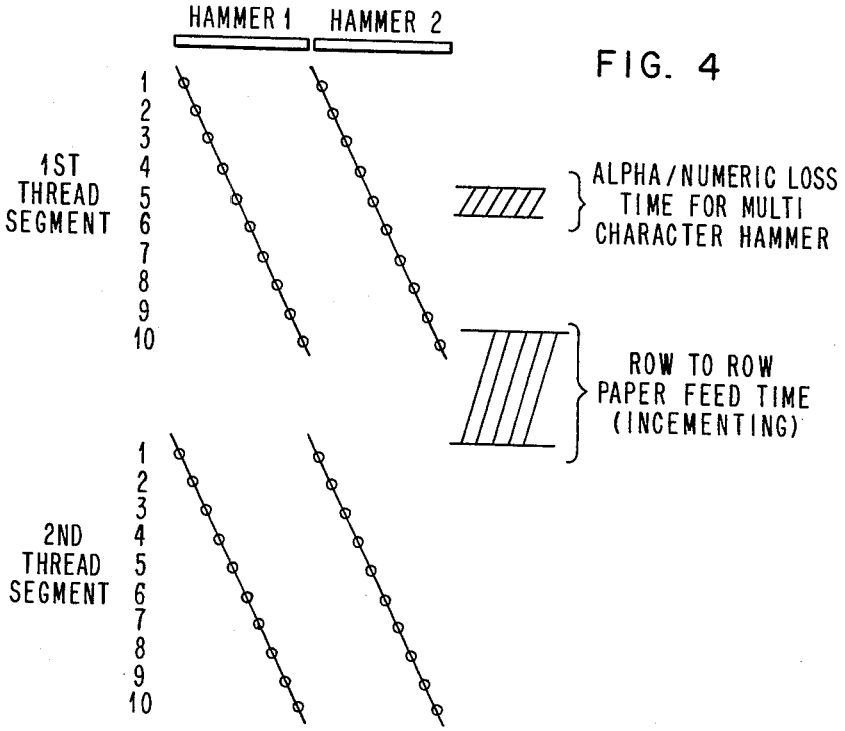
FIG. 4 illustrates the segmented helical pattern thread and shows how the time required for achieving proper synchronization can be reduced in the present invention.

Turning to FIG. 4, another schematic layout similar to FIG. 2 is shown but is for the segmented helical pattern of the present invention instead. It will be observed from FIG. 4 that dot positions 5 and 10 are again circled for leaving them blank and that the alpha numeric time loss for spacing between characters is thus the same as it was in FIG. 2. The row to row paper incrementation time shown in FIG. 4 is also the same as that in FIG. 2. However, it will be observed that the start of the next thread segment is appropriately located for instant synchronization following the row to row paper feed time so that no further delay is created, contrary to the situation that was present in FIG. 2 for the continuous helical path. Thus the second thread segment starts in FIG. 4 are in proper position at the proper time to commence immediately with the firing of the hammers to generate the second row of dots in the various character positions.

It may be appreciated that by appropriately delaying the firing of a given hammer or by varying the speed of rotation of drum 1 a dot may be printed anywhere along a horizontal line and that by appropriate vertical spacing or incrementing of the paper a dot may be printed anywhere in the vertical dimension.

Figure 5:
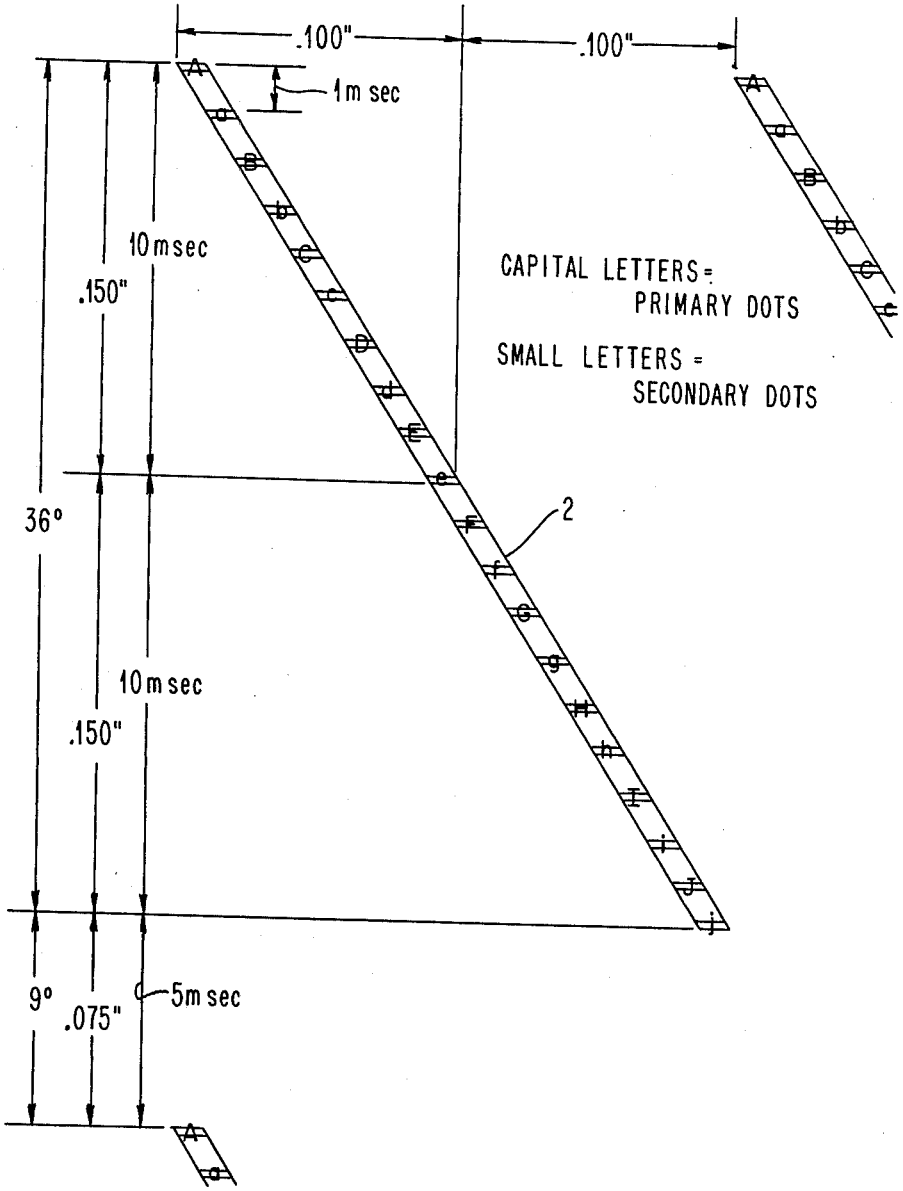
FIG. 5 illustrates a greatly enlarged detail of a helical thread segment in the preferred embodiment of the present invention.

Turning to FIG. 5, primary and secondary dot positions for a given helical thread segment 2 are shown in an enlarged view. Capital letters identify the primary dot or hammer firing positions while the small letters illustrate the secondary or intermediate dot positions which can be generated by firing the hammers more rapidly or by delaying them appropriately. Under the example given herein, ten milliseconds pass between the start of a thread segment and the completion of the fifth secondary dot position. This corresponds to the total width plus space of one character in a standard four by seven or five by seven character matrix. A space of approximately 0.15" is used circumferentially on the drum which corresponds to about 18° of circular arc. The second character positions begin immediately and span the same distances and utilize the same times. An additional 9° of arcuate rotation of the drum requiring approximately 5 milliseconds at the rotational speed assumed herein is required to increment the paper and prepare for the printing of the second row of dots in a given character. This is shown in FIG. 5 where the beginning of the second segment of a helical thread pattern is shown at the bottom of the diagram.

Turning to FIG. 6, the details are illustrated for constructing an emitter grid for a drum to time the various hammer firings. The arcuate 36° segments utilized in creating each row of dots are laid out as shown in FIG. 6 for a seven row high character. The left and right character positions for each given hammer are identified by the sub arcuate increments so labeled and the primary dot generation positions are labeled A through J as shown. The row to row paper feed time available in FIG. 6 spans approximately 12.6° of arc if only four dot positions in the horizontal dimension in each character plus one skipped dot (the fifth dot position) are utilized as previously described. This explains the difference between FIG. 6 row to row paper feed time and that shown in FIG. 5 since the primary and second dot positions J actually are a character to character space and can thus be utilized for paper feeding time as is reflected in FIG. 6. The time available for line to line paper feed spans a full 45° arcuate segment as shown in FIG. 6 but can also utilize the time after the end of the seventh row at dot I as illustrated for line to line paper feeding time.

As is apparent from the figures and the discussion given, the present invention reduces the time delay to establish resynchronization with a helical thread to commence printing at the start of a first dot in the horizontal rows for characters in a line printer of this type. The invention does not provide any less function since a dot may be presented or printed anywhere along the horizontal lines dependent only upon the timing of the wire fires and synchronization with the helical thread patterns. An additional benefit is produced by segmenting and offsetting the helical segments relative to one another in that the "shadow" effect of striking a hammer against a helical segment near its end will not also impact an area near the beginning of another segment and inadvertently cause printing there.

Having thus described our invention with regard to a preferred embodiment thereof, what is desired to be protected by Letters Patent and what is claimed is:

1. In a mosaic printer having a cylindrical rotating drum, rotating at some arbitrary fixed rate, the outer surface of which has at least one raised spiral thread, and having at least one print hammer located adjacent to said drum and being provided with means for firing said hammer to impact against said spiral thread at desired times, and a printing medium interposed between said hammer and said thread and means associated with said printing medium for moving said medium at some arbitrary feed rate between said hammer and said drum to effect printing operations in either incremental or fixed speed modes, and timing means for controlling the times during the revolution of said drum that said hammer is moved to impact said medium against a portion of said spiral thread, the improvements comprising:

said spiral thread being divided into a plurality of segments; and the endings and beginnings, respectively, of each of said segments relative to the preceding and succeeding segments thereof being offset from one another circumferentially on said drum by a distance at least equal to that distance traversed by any point on the periphery of said drum at said rate of revolution thereof during the time required by said moving means to move said print medium at said rate to a new printing position.

2. Apparatus as described in claim 1, wherein:

said segments are set at a pitch angle and are of an arcuate length on the circumference of said drum such that each arcuate thread segment passes a fixed reference point in a time controlled by the rotational speed of said drum which time, when added to the time for incrementing said medium between rows of dots, occupies a whole integral fraction of the surface of said drum which fraction may be represented as 1/n with n being the number of thread segments passing a given fixed reference point at the periphery of and external to said drum.

3. Apparatus as described in claim 1 or claim 2 wherein:

said integral number n is chosen as equal to the number of vertical dots to be formed in a given character format plus one.

4. Apparatus as described in claim 1 or 2, wherein:

said segments are set at a pitch to exactly span an axial distance on said drum equal to the width of a said print hammer.

5. Apparatus as described in claim 1 or 2, wherein:

said integral number n is chosen as equal to the number of vertical dots to be formed in a given character format plus one; and said segments are set at a pitch to exactly span an axial distance on said drum equal to the width of a said print hammer.

6. Apparatus as described in claim 1 or 2 wherein:

the beginning of each said segment of helical thread is circumferentially aligned with other beginnings of segments and lies in a common circumferential path made by a plane perpendicular to the axis of said cylinder.

7. Apparatus as described in claim 2, wherein:

said integral number n is chosen as equal to the number of vertical dots to be formed in a given character format plus one; and said segments are set at a pitch to exactly span an axial distance on said drum equal to the width of a said print hammer; and the beginning of each said segment of helical thread is circumferentially aligned with other beginnings of segments and lies in a common circumferential path made by a plane perpendicular to the axis of said cylinder.

* * * * *